United States Patent [19]

Yamashita

[11] Patent Number: 4,946,019

[45] Date of Patent: Aug. 7, 1990

[54] COIN DISCRIMINATOR WITH PHASE DETECTION

[75] Inventor: Riichiro Yamashita, Tokasago, Japan

[73] Assignee: Mitsubishi Jukogyo Kabushiki Kaisha, Tokyo, Japan

[21] Appl. No.: 317,823

[22] Filed: Mar. 1, 1989

[30] Foreign Application Priority Data

Mar. 7, 1988 [JP] Japan ..... 63-52967

[51] Int. Cl.[5] ..... G07D 5/08

[52] U.S. Cl. ..... 194/318; 324/83 R

[58] Field of Search ..... 194/317, 318, 319, 320; 73/163; 324/57 R, 83 R, 83 D, DIG. 1

[56] References Cited

U.S. PATENT DOCUMENTS 3,316,896 5/1967 Thomasset ..... 324/57 R X
3,473,117 10/1969 Ito ..... 324/57 R
3,966,034 6/1976 Heiman et al. ..... 194/318
4,174,498 11/1979 Preikschat ..... 324/57 R
4,409,543 10/1983 Sugihara ..... 324/83 R X
4,460,080 7/1984 Howard ..... 194/317
4,574,936 3/1986 Klinger ..... 194/318

FOREIGN PATENT DOCUMENTS 49-119696 3/1974 Japan .
58-56154 12/1983 Japan .
60-58514 12/1985 Japan .

*Primary Examiner*—F. J. Bartuska
*Attorney, Agent, or Firm*—Stanger, Michaelson, Spivak & Wallace

[57] ABSTRACT

In a coin discriminator which compares a reference value to impedance magnitude variations induced by a coin, a phase detector detects the phases of the impedance variations and compares them with a standard to discriminate between the coins.

1 Claim, 2 Drawing Sheets

COIN DISCRIMINATOR WITH PHASE DETECTION

FIELD OF THE INVENTION AND RELATED ART STATEMENT

The present invention relates to a coin discriminator which is applied to an automatic charge collector and the like and more particularly to improvement of discrimination capability of coins.

Heretofore, various propositions have been made for a coin selection method and apparatus.

A coin discriminator disclosed in, for example, Japanese open-laid patent application SHO No. 49-119696 causes a coin to fall obliquely in a strong magnetic field at an intitial constant velocity so that an eddy current is generated in the coin by the strong magnetic field. Interaction between the eddy current and the strong magnetic field forms a braking power which changes the track of the coin. This coin discriminator utilizes the fact that the change of the track is dependent on the conductivity of the coin.

A coin selection apparatus disclosed in JP No. 58-56154 uses two coils each having a different gap between a coin and the coil to detect phase variations in both the coils by the coin in the same frequency so that the coin is identified on the basis of the phase variations obtained from the detecting coils to select the coin by an AND logic of both identification signals.

A coin selection apparatus disclosed in JP No. 60-58514 selects a coin on the basis of a ratio of an inductance of a detecting coil at a high frequency range where there is no coin and an inductance of the coil in the case where there is the coil.

A conventional coin selection apparatus employs a bridge circuit including a detecting coil and a reference coil to select a coin on the basis of a variation of its impedance thereof. Such a coin selection apparatus is shown in a portion enclosed by phantom lines in FIG. 1. The coin selection apparatus comprises a bridge circuit 5 including a detecting coil 2, a reference coil 3 and a balance circuit 4, an oscillator 6 which supplies a high frequency voltage to the bridge circuit 5, a tuning amplifier 7 which amplifies an output voltage of the bridge circuit 5, a low pass filter 8 which detects a low frequency component of an output voltage variation of the bridge circuit 5 which is proportional to a variation of an impedance of the detecting coil 2 when a coin passes within a magnetic field, and a comparator 9 which discriminates an output voltage level of the bridge circuit 5.

The coin discriminator discriminates a kind of a coin on the basis of only a magnitude of the output voltage of the bridge circuit and accordingly there is a problem that the discriminator has a tendency to discriminate in error a different coin formed in a different shape and of different material.

FIG. 2 is a diagram showing an impedance characteristic of coins. Referring to FIG. 2, the problem in the prior art apparatus is described in detail.

An impedance Z of a coil can be decomposed into a real component X (resistance) and an imaginary component Y (reactance) and a ratio of the components X and Y is $\tan^{-1}(X/Y)=\theta$ where $\theta$ is a phase. The impedance can be expressed by a magnitude of an absolute value and the phase $\theta$. Za, Zb, Zc and Zd represent impedance variations of coins A, B, C and D, respectively. The impedance variations Za, Zb and Zc of the coins A, B and C formed of the same material and having different diameters, respectively, are plotted on the complex plane with a substantially identical phase $\theta 1$, while the impedance variation Zd of the coin D formed of different material from that of the coins A, B and C is plotted on the complex plane with a phase $\theta 2$ different from the phase $\theta 1$.

The impedance variations Za, Zb, Zc and Zd are to be converted to the output voltages of the bridge circuit 5. Accordingly, as could be seen from FIG. 2, there is no problem in the case where the absolute values of the impedance variations such as Za, Zb and Zc are different from each other. However, when the absolute values of the impedance variations such as Zb and Zd are substantially identical, the coins B and D are not discriminated of effect wrong discrimination even if the coins are discriminated on the basis of only the absolute values of the impedance, that is, voltage levels.

OBJECT AND SUMMARY OF THE INVENTION

It is an object of the present invention to provide a coin discriminator having excellent discrimination capability and which can exactly discriminate coins which have the same impedance and could not be discriminated by a conventional discriminator.

In order to achieve the above object, the coin discriminator according to the present invention comprises, in addition to the conventional impedance discrimination circuit, a phase shifter for generating an in-phase voltage and a voltage delayed by $\pi/2$ in phase while a voltage of the oscillator of the bridge circuit is assumed as a reference voltage, a phase detector for detecting as in-phase component and a $\pi/2$-phase-delayed component from an output voltage of the tuning amplifier supplied with the output of the bridge circuit, a low pass filter for cutting a high frequency component in the in-phase voltage and the $\pi/2$-phase-delayed voltage and detecting only a low frequency component of variation of a voltage which varies when the coin passes through the detecting coil, a phase calculator for calculating a phase of an impedance variation voltage by the coin on the basis of the in-phase component voltage and the $\pi/2$-phase-delayed component voltage supplied from the low pass filter, and a logic circuit for effecting the AND operation of an output of the impedance level discrimination circuit and an output of the phase calculator.

In addition to the discrimination output on the basis of the absolute value of the impedance variation in the prior art, the discrimination output on the basis of the phase variation is obtained to discriminate a kind of a coin by the logical product of both the outputs. Accrodingly, exact discrimination of the kind of the coin can be attained for a coin of a type that could not be discriminated in the prior art since the impedance is identical although the phase is different.

DETAILED DESCRIPTION OF A PREFERRED EMBODIMENT

Figure 1:
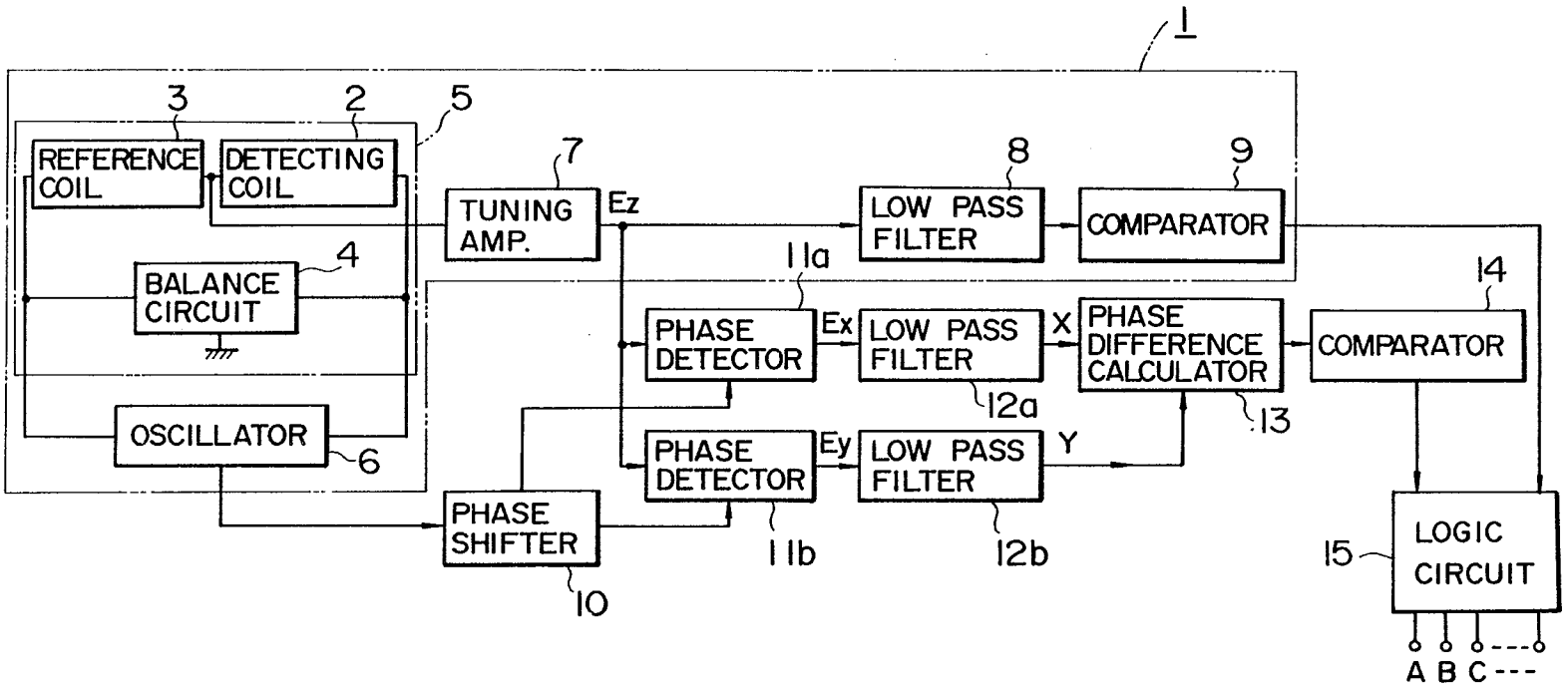
FIG. 1 is a block diagram showing a circuit configuration of a coin discriminator according to an embodiment of the present invention.

FIG. 1 is a block diagram showing a configuration of a coin discriminator according to an embodiment of the present invention. As described above, the circuit enclosed by phantom line 1 is the impedance discrimination circuit having the same configuration as that of the prior art. That is, reference numeral 2 denotes the detecting coil, 3 the reference coil, and 4 the balance circuit, which constitute the bridge circuit 5. Reference numeral 6 denotes the oscillator which supplies a high frequency voltage to the bride circuit 5. The bridge circuit 5 adjusts the balance circuit 4 to set an output (an intermediate output between the detecting coil 2 and the reference coil 3) of the bridge circuit 5 to zero when there is no coin within the magnetic field generated by the detecting coil 2. In the adjusted state, when a coin enters the detecting coil 2, the detecting coil 2 produces a variation in the impedance thereof in accordance with a shape and material of the coin and an output voltage of the bridge circuit 5 is varied in proportion to the variation of the impedance. The tuning amplifier 7 selects a frequency component of an output voltage of the bridge circuit 5 to remove other noise components and amplifies the output of the bridge circuit. The low pass filter 8 cuts a high frequency component which is supplied to the bridge circuit 5 and detects a variation of a low frequency voltage generated due to the coin opposed to the detecting coil 2. Since the magnitude of the voltage produced from the low pass filter 8 is different depending on a kind of the coin (shape and material), the comparator 9 discriminates the kind of the coin by a discrimination level set thereto.

Figure 3:
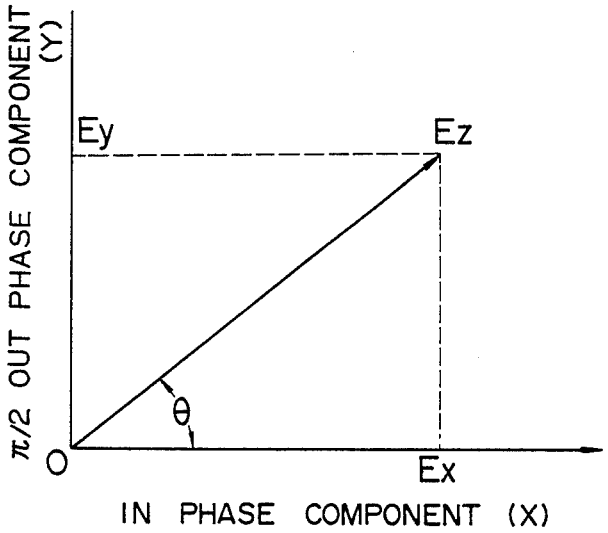
FIG. 3 is a diagram explaining phase components of an output voltage of a bridge circuit.

On the other hand, a phase shifter 10 is supplied with a voltage of the oscillator 6 constituting the power supply of the bridge circuit and generates an in-phase voltage and a voltage delayed by $\pi/2$ in phase which are supplied to phase detectors 11*a* and 11*b*, respectively. The phase detectors 11*a* and 11*b* are also supplied with output volage Ez produced from the tuning amplifier 7 and decompose it into an in-phase component (a real component of an impedance) and a component delayed by $\pi/2$ in phase (an imaginary component of an impedance). FIG. 3 shows the output voltage Ez decomposed into the in-phase component and the component delayed by $\pi/2$ in phase.

Assuming that the output voltage Ez is produced from the tuning amplifier 7 when a coin is opposed to the detecting coil 2, the in-phase detector 11*a* produces an in-phase component Ex of the voltage Ez and the $\pi/2$-phase detector 11*b* produces a component Ey delayed by $\pi/2$ in phase. The components Ex and Ey correspond to the real component and the imaginary component of the impedance shown in FIG. 2, respectively. Since the components Ex and Ey contain a high frequency component, the components Ex and Ey are supplied to low pass filters 12*a* and 12*b*, respectively, to detect low frequency components thereof (variation when the coin passes through the detecting coil 1) and are decomposed into a real component voltage X and an imaginary component voltage Y for measurement, respectively. The real and imaginary component voltages X and Y are supplied to a phase difference calculator 13 which calculates a phase $\theta=\tan^{-1}(Y/X)$ from a ratio thereof. The calculated phase $\theta$ is varied in accordance with variation of a shape and material of the coin. The phase $\theta$ is classified by a comparator 14 and is supplied to a logic circuit 15 which calculates a logical product of the output of the comparator 14 and the impedance level, that is, the output produced from the comparator 9 to discriminate a kind of the coin.

Figure 2:
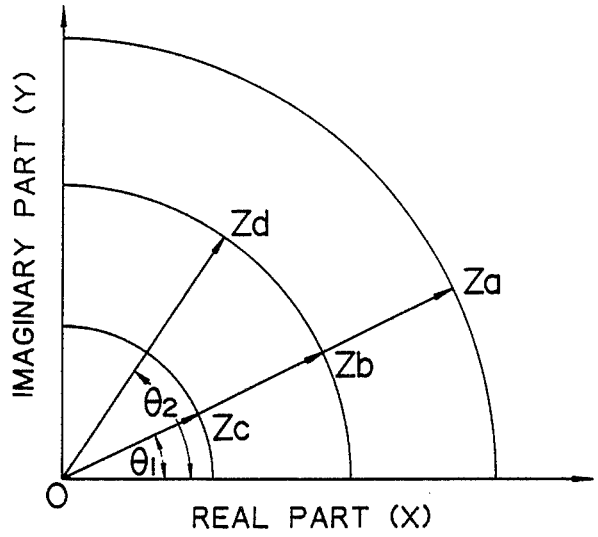
FIG. 2 is a diagram showing an impedance characteristic of coins.

As an example, logical equations for the coins A, B, C and D shown in FIG. 2 are given by $$A=Za\times\theta 1$$

$$B=Zb\times\theta 1$$

$$C=Zc\times\theta 1$$

$$D=Zd\times\theta 2.$$

Accordingly, the coins B and D having the same impedance variation, that is, $Zb\approx Zd$ can be discriminated extremely accurately from the result of the logical product of the phase $\theta$ and the output of the comparator 9 although the coins B and D could not be discriminated in the prior art.

It is a matter of course that the impedance levels Za, Zb, Zc and Zd and the phases $\theta 1$ and $\theta 2$ are discriminated by the comparators 9 and 14, respectively, in which the respective set zones are provided. Thus, the coin discriminator according to the present invention discriminates a coin on the basis of a location on the complex impedance plane of the output signal of the circuit.

The present invention is not limited to the embodiment and various modifications can be implemented without departing from the gist of the present invention.

According to the present invention, since the coin discrimination is effected on the basis of the logical product of the impedance level and the phase information of the impedance, the discrimination can be exactly attained for a coin of a different type which could not be discriminated by the conventional discrimination means using only the impedance level.

I claim:

1. A coin discriminator including an impedance level discrimination circuit provided with a bridge circuit including a detecting coil, a reference coil and a balance circuit, an oscillator for supplying a high frequency voltage to the bridge circuit, a tuning amplifier for amplifying an output voltage of the bridge circuit, a low pass filter for detecting a low frequency component of a variation of a voltage proportional to an absolute value of a variation of an impedance in the detecting coil when a coin passes through the detecting coil, and a comparator for comparing a voltage level of the impedance variation of the detecting coil with predetermined voltage levels, comprising a phase shifter for producing an in-phase voltage and a voltage delayed by $\pi/2$ in phase with regard to the oscillation voltage of the oscillator, phase detectors for detecting an in-phase component and a component delayed by $\pi/2$ in phase from an output voltage of the tuning amplifier on the basis of the in-phase voltage and the voltage delayed by $\pi/2$ in phase produced by said phase shifter, respectively, low pass filters for cutting high frequency coponents from the in-phase component voltage and the $\pi/2$-phase-delayed component voltage, respectively, to detect low frequency component of variation of a voltage when the coin passes through the detecting coil, a phase difference calculator for calculating a phase difference of the impedance variation of the detecting coil caused by the coin on the basis of the in-phase component voltage and the $\pi/2$-phase-delayed component voltage produced from said low pass filters, respectively, and a logic circuit for calculating a logical product of an output of the impedance level discrimination circuit and an output of said phase difference calculator to discriminate a coin.

* * * * *